US006293033B1

(12) United States Patent
Moriya et al.

(10) Patent No.: US 6,293,033 B1
(45) Date of Patent: Sep. 25, 2001

(54) CONSTRUCTION MACHINERY

(75) Inventors: Naoyuki Moriya; Hideto Furuta, both of Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/381,901

(22) PCT Filed: Mar. 8, 1999

(86) PCT No.: PCT/JP99/01126

§ 371 Date: Oct. 14, 1999

§ 102(e) Date: Oct. 14, 1999

(87) PCT Pub. No.: WO99/58771

PCT Pub. Date: Nov. 18, 1999

(30) Foreign Application Priority Data

May 11, 1998 (JP) ..... 10-127370
Dec. 10, 1998 (JP) ..... 10-351307

(51) Int. Cl.[7] ..... E02F 9/20
(52) U.S. Cl. ..... 37/348; 701/50
(58) Field of Search ..... 37/348, 414, 382; 172/2–11, 812; 701/50, 36, 53, 56; 417/212, 213, 216; 414/695–700, 715–720

(56) References Cited

U.S. PATENT DOCUMENTS 5,224,033 * 6/1993 Nakamura et al. ..... 172/2 X
5,287,699 * 2/1994 Takamura et al. ..... 60/327
5,513,551 * 5/1996 Morishita ..... 91/459
5,682,312 * 10/1997 Rocke ..... 37/414 X
5,737,993 * 4/1998 Cobo et al. ..... 91/361
5,918,527 * 7/1999 Haga et al. ..... 172/4.5 X
5,999,872 * 12/1999 Kinugawa et al. ..... 701/50
6,047,228 * 4/2000 Stone et al. ..... 701/50
6,079,131 * 6/2000 Oshina et al. ..... 37/348
6,119,054 * 9/2000 Miki et al. ..... 700/275

FOREIGN PATENT DOCUMENTS 63-116565 7/1988 (JP) .
B2-3-61811 9/1991 (JP) .
6-213211 8/1994 (JP) .

* cited by examiner

*Primary Examiner*—Robert E. Pezzuto
(74) *Attorney, Agent, or Firm*—Oliff & Berridge PLC

(57) ABSTRACT

In a construction machine including a control unit for receiving operating signals from operating members and outputting operation commands to actuators, by using a monitor and control levers, correlations between the control levers or switches and the actuators, i.e., an input/output relationship between any of the control levers and corresponding one of electro-hydraulic conversion valves, can be freely set. The set input/output relationships are registered in a memory in a rewritable manner.

20 Claims, 5 Drawing Sheets

CONSTRUCTION MACHINERY

TECHNICAL FIELD

The present invention relates to the technical field of a construction machine such as a hydraulic shovel.

BACKGROUND ART

Generally, construction machine such as hydraulic shovels each include a plurality of actuators such as a swing motor and a boom cylinder, and a plurality of operating members for operating the actuators. Some of those construction machines are constructed such that operating signals from the operating members are inputted to a control unit which outputs operation commands to the actuators in accordance with the inputted operating signals.

Meanwhile, operability of construction machines has been poor in the past because correlations (operational patterns) between operating members and actuators operated upon manipulation of the operating members have not been standardized, and the correlations differ depending on manufacturers, the models and types of the construction machines, or the JIS (Japanese Industrial Standards) specifications. It has been therefore required to be able to change the operational patterns in match with operators. Such a change of the operational patterns has been hitherto performed by rearranging connections of lines between actuators and valves operated by the operating members. However, rearranging works of line connections have been problematic in that they are complicated and troublesome, and are poor in efficiency.

In consideration of the above problem, as disclosed in JP-B2-3-61811, there has been proposed such a system that several kinds of operational patterns are stored in a memory of a control unit beforehand, and the operator can select any desired one of the stored operational patterns.

The system disclosed in JP-B2-3-61811 however has the problem that because the desired one is selected from among the several kinds of operational patterns stored in the memory beforehand, the operator cannot select an operational pattern other than those stored in the memory, and therefore the system is not flexibly adaptable for various needs.

On the other hand, it is conceivable to store all the operational patterns in the memory. This solution would however give rise to the following problems. Assuming, for example, that two joy stick levers are used to control the extending and contracting operations of a boom cylinder, a stick cylinder and a bucket cylinder, and the leftward and rightward swing operations of a swing motor, total 40320 kinds of operational patterns at maximum must be stored and a large-capacity memory is required. In addition, the process of selecting the desired one from among such a large number of operational patterns is also complicated. Those problems are to be solved by the present invention.

DISCLOSURE OF THE INVENTION

In view of the state of art set forth above, the present invention has been made with the object of solving the above-mentioned problems. According to the present invention, in a construction machine comprising a plurality of actuators, a plurality of operating members for operating the actuators, and a control unit for receiving operating signals from the operating members and outputting operation commands to the actuators, the control unit is connected to setting means for setting an input/output relationship between any of the plurality of operating members and any of the plurality of actuators, and the control unit includes a memory for storing in a rewritable manner the input/output relationships set by the setting means.

With the above features, the correlations between the operating members and the actuators can be optionally set to make the construction machine adaptable for various needs, and the capacity of the memory used can be reduced.

In the above construction machine, the setting means is constructed such that, by manipulating any of the plurality of operating members in a state in which any of the plurality of actuators is selected by selecting means, the input/output relationship between the manipulated operating member and the selected actuator is set. By so constructing the setting means, the correlations between the operating members and the actuators are set upon the operating members being manipulated by the operator himself. As a result, the setting is simple to implement and the operator can surely keep in mind the set correlations In the above construction machine, the operating members are control levers, control pedals and/or control switches, and the actuators are operated under proportional control, on/off control and/or toggle control. More concretely, the operating signals are provided from sensors for detecting the directions and angles of the control levers, and the actuators are a boom cylinder, a stick cylinder, a bucket cylinder and a swing hydraulic motor. Further, the operating signals are signals from switches provided on the control levers and the control pedals, and the actuators are a dozer cylinder, a tilt cylinder and an angle cylinder.

DETAILED DESCRIPTION OF PREFERRED EMBODIMENT

Figure 1:
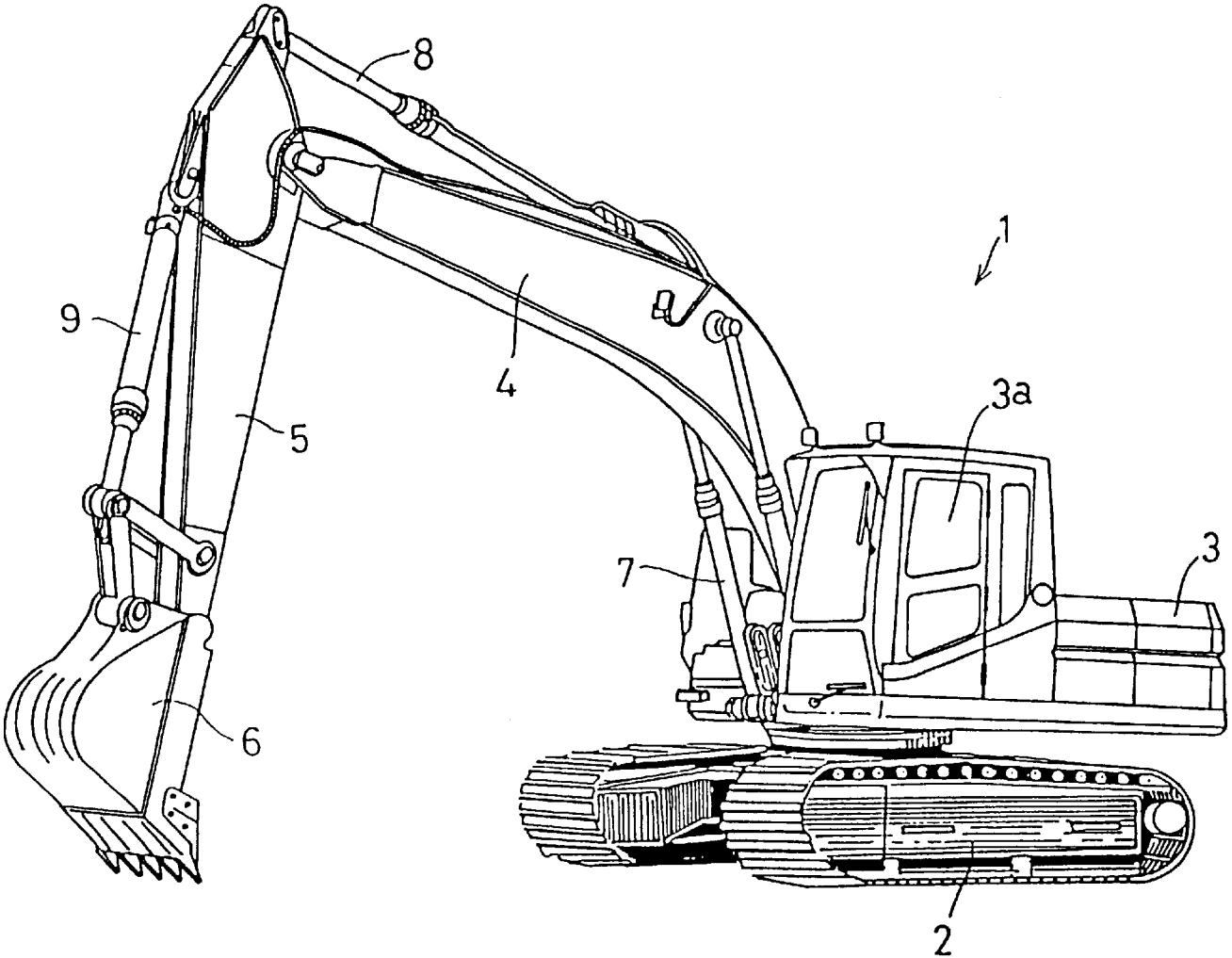
FIG. 1 is a perspective view of a hydraulic shovel.
Figure 2:
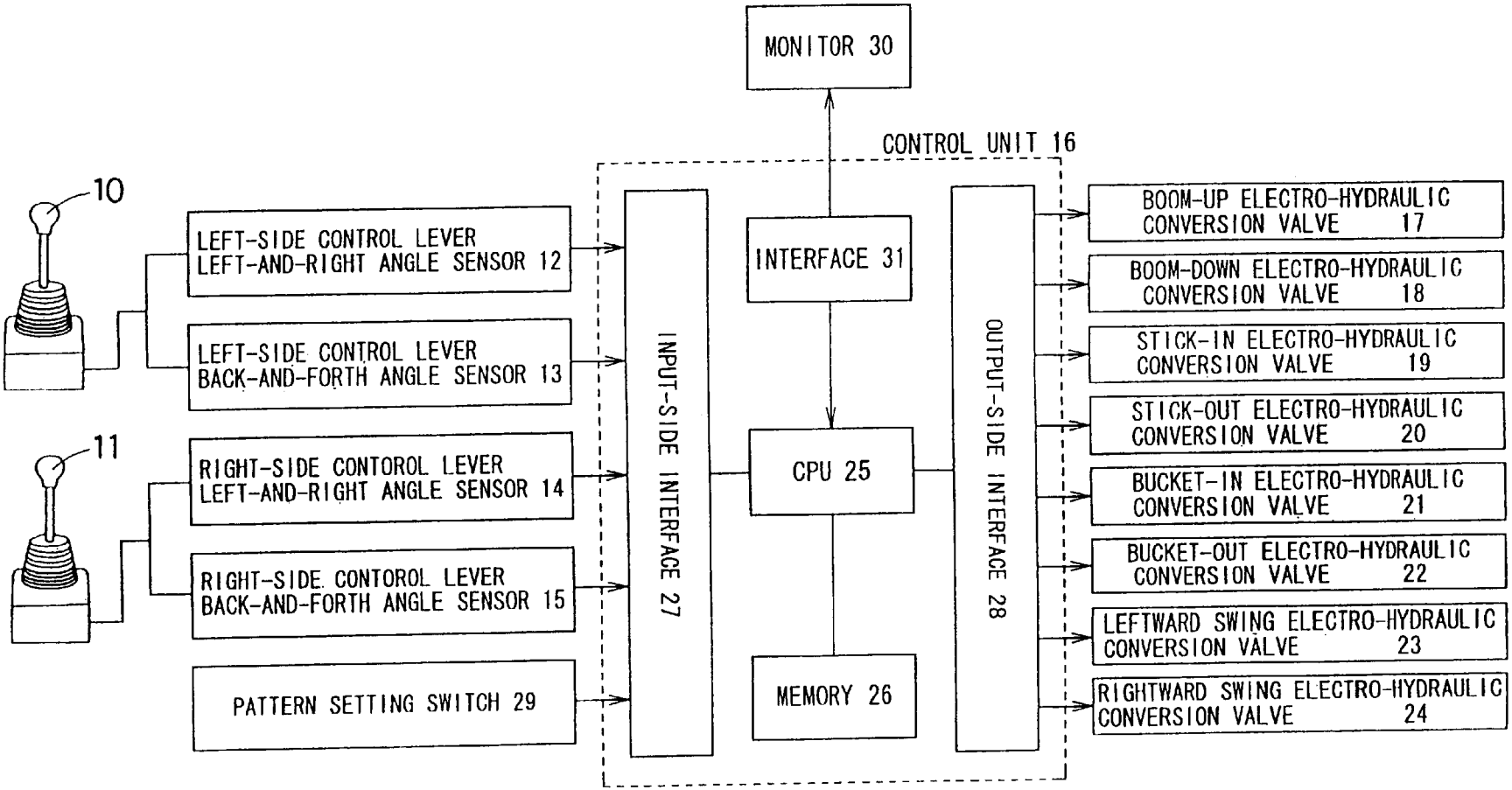
FIG. 2 is a block diagram showing inputs and outputs to and from a control unit.

An embodiment of the present invention will be described below with reference to the drawings. In the drawings, numeral 1 denotes a hydraulic shovel. The hydraulic shovel 1 comprises a crawler type traveling section 2, an upper swinging section 3 supported on the traveling section 2 in a swingable manner, a boom 4 supported by the upper swinging section 3 in a vertically swingable manner, a stick 5 supported to a fore end of the boom 4 in a back-and-forth swingable manner, a bucket 6 supported to a fore end of the stick 5 in a back-and-forth swingable manner, etc. Further, the hydraulic shovel 1 includes various hydraulic actuators such as a boom cylinder 7, a stick cylinder 8 and a bucket cylinder 9 for swinging the boom 4, the stick 5 and the bucket 6, respectively, and a swing motor for swinging the upper swinging section 3. Such a basic construction of the hydraulic shovel 1 is the same as conventional.

Also, numerals 10, 11 denote left and right control levers of the joy stick type which are disposed in a cab 3*a*. The amounts by which the control levers 10, 11 are manipulated in the left-and-right direction and in the back-and-forth direction are detected respectively by a left-side control lever left-and-right angle sensor 12, a left-side control lever back-and-forth angle sensor 13, a right-side control lever left-and-right angle sensor 14, and a right-side control lever back-and-forth angle sensor 15. Values detected by those angle sensors 12–15 are inputted to a later-described control unit 16.

On other hand, numerals 17–24 denote a boom-up (boom cylinder extending) electro-hydraulic conversion valve, a boom-down (boom cylinder contracting) electro-hydraulic conversion valve, a stick-in (stick cylinder extending) electro-hydraulic conversion valve, a stick-out (stick cylinder contracting) electro-hydraulic conversion valve, a bucket-in (bucket cylinder extending) electro-hydraulic conversion valve, a bucket-out (bucket cylinder contracting) electro-hydraulic conversion valve, a leftward swing electro-hydraulic conversion valve, and a rightward swing electro-hydraulic conversion valve for controlling control valves (not shown) associated with the boom cylinder 7, the stick cylinder 8, the bucket cylinder 9, and the swing motor, respectively. Those electro-hydraulic conversion valves 17–24 are set to operate in accordance with control commands from the control unit 16 for controlling the associated control valves.

The control unit 16 comprises a CPU 25, a memory 26, an input-side interface 27, an output-side interface 28, etc. The control unit 16 is set to receive signals from the angle sensors 12–15 and a later-described pattern setting switch 29, etc., and to output command signals to the electro-hydraulic conversion valves 17–24 based on the input signals. Further, the control unit 16 is connected via an interface 31 to a monitor 30 disposed in the cab 3*a*.

The pattern setting switch 29 is a switch used when setting correlations (operational patterns) between the control levers 10, 11 and the electro-hydraulic conversion valves 17–24. When the pattern setting switch 29 is in an off-state, the control unit 16 is set to a "normal control" state for operating corresponding ones of the electro-hydraulic conversion valves 17–24 in accordance with the manipulation of the control levers 10, 11. When the pattern setting switch 29 is in an on-state, the control unit 16 is set to a "pattern setting control" state for setting the operational patterns.

While, in this embodiment, the control unit 16 is set to the "pattern setting control" state by turning on the pattern setting switch 29, the present invention is not limited to the illustrated embodiment. For example, the "pattern setting control" state may be set by providing a "pattern setting control" screen as one of menu screens displayed on the monitor, and selecting the relevant menu. It is just essential that there is a means for switching over control of the control unit 16 to the "pattern setting control" for setting the operational patterns.

Procedures in the case of setting the operational patterns will be described below. First, when the pattern setting switch 29 is turned on, the operation of the hydraulic actuator, e.g., "boom-up", to be set into the operational pattern is displayed on the monitor 30 (the display may be presented in any suitable form such as characters, a symbol, a pattern figure, etc. so long as the operator can recognize "boom-up"). In this state, the operator manipulates the control lever 10 or 11, to which he wants to assign "boom-up", in a direction in which "boom-up" is to be assigned, i.e., in one of the forward, backward, leftward and rightward directions. Assuming now that the operator manipulates the left-side control lever 10 backward, for example, a detection signal from the left-side control lever back-and-forth angle sensor 13 is inputted to the control unit 16. Upon receiving that detection signal, the control unit 16 stores in the memory 26 the correlation between the backward manipulation of the left-side control lever 10 and the boom-up electro-hydraulic conversion valve 17 (i.e., the input/output relationship of outputting the input signal from the left-side control lever back-and-forth angle sensor 13 to the boom-up electro-hydraulic conversion valve 17). Further, the control unit 16 stores in the memory 26 the correlation between the manipulation in an direction opposed to the above "boom-up" manipulation, i.e., the forward manipulation of the left-side control lever 10, and the boom-down electro-hydraulic conversion valve 18.

Subsequently, when the operator returns the left-side control lever 10, which has been manipulated so far, to its neutral position, the operation of the hydraulic actuator, e.g., "stick-in", to be next set into the operational pattern is displayed on the monitor 30. Then, when the operator manipulates the control lever 10 or 11, to which he wants to assign "stick-in", in a direction in which "stick-in" is to be assigned, the correlation between the manipulation of the control lever 10 or 11 in the direction in which it is manipulated and the stick-in electro-hydraulic conversion valve 19, and the correlation between the manipulation of the control lever 10 or 11 in a direction opposed to the direction in which it is manipulated and the stick-out electro-hydraulic conversion valve 19 are stored in the memory 26. Furthermore, the correlations between the control lever 10, 11 and the bucket-in, bucket-out, leftward swing and rightward swing electro-hydraulic conversion valves 21–24 are likewise stored in the memory 26.

When the pattern setting switch 29 is turned off after the completion of setting of all the operational patterns, the correlations (operational patterns) stored in the memory 26 are displayed on the monitor 30, and the control unit 16 is returned to the "normal control" state. When the control levers 10, 11 are manipulated thereafter, corresponding operation commands are outputted to the electro-hydraulic conversion valves 17–24 in accordance with the operational patterns stored in the memory 26. Note that the operational patterns stored in the memory 26 are erased by turning on the pattern setting switch 29 next.

Here, since "boom-up" and "boom-down", "stick-in" and "stick-out", "bucket-in" and "bucket-out", and "leftward swing" and "rightward swing" are usually set in pair to be effected upon the same control lever 10 or 11 being manipulated in opposed directions, the above embodiment is constructed such that when the operational pattern of "boom-up", for example, is set, the operational pattern of "boom-down" is also automatically set. The operational pattern, however, may be set separately for each of the above operations.

Also, while the above embodiment is constructed so as to successively display the operations of the hydraulic actuators to be set into the operational patterns, the present invention is not limited to such a construction. For example, the construction may be modified such that the operator can select the hydraulic actuator, for which the setting is to be made, using buttons, a keyboard, or the like provided in the cab.

Incidentally, the operational patterns according to the JIS specifications, for example, are initially stored as "standard operational patterns" in the memory 26. When the operator does not perform the above-described operation for setting the operational patterns, operation commands are outputted to the electro-hydraulic conversion valves 17–24 in accordance with the "standard operational patterns".

In the thus-constructed construction machine of this embodiment, the correlations between the control levers 10, 11 and the boom cylinder 7, the stick cylinder 8, the bucket cylinder 9 and the swing motor can be optionally set by the operator who manipulates the control lever 10 or 11, which is to be assigned to the hydraulic actuator displayed on the monitor 30, in a state that the pattern setting switch 29 is turned on, as described above.

As a result, this embodiment enables the operator to set the desired operational patterns at his discretion, and is therefore adaptable for various needs. Further, since the operational patterns are set upon the control lever 10 or 11 being manipulated by the operator himself, the setting is simple to implement and the operator can surely keep in mind the set operational patterns.

In addition, with this embodiment, only the set operational patterns are stored in the memory 26 while the desired operational patterns can be optionally set, as described above. It is therefore possible to reduce the capacity of the memory 26 used, and to avoid an increase in size of the memory 26.

Figure 3:
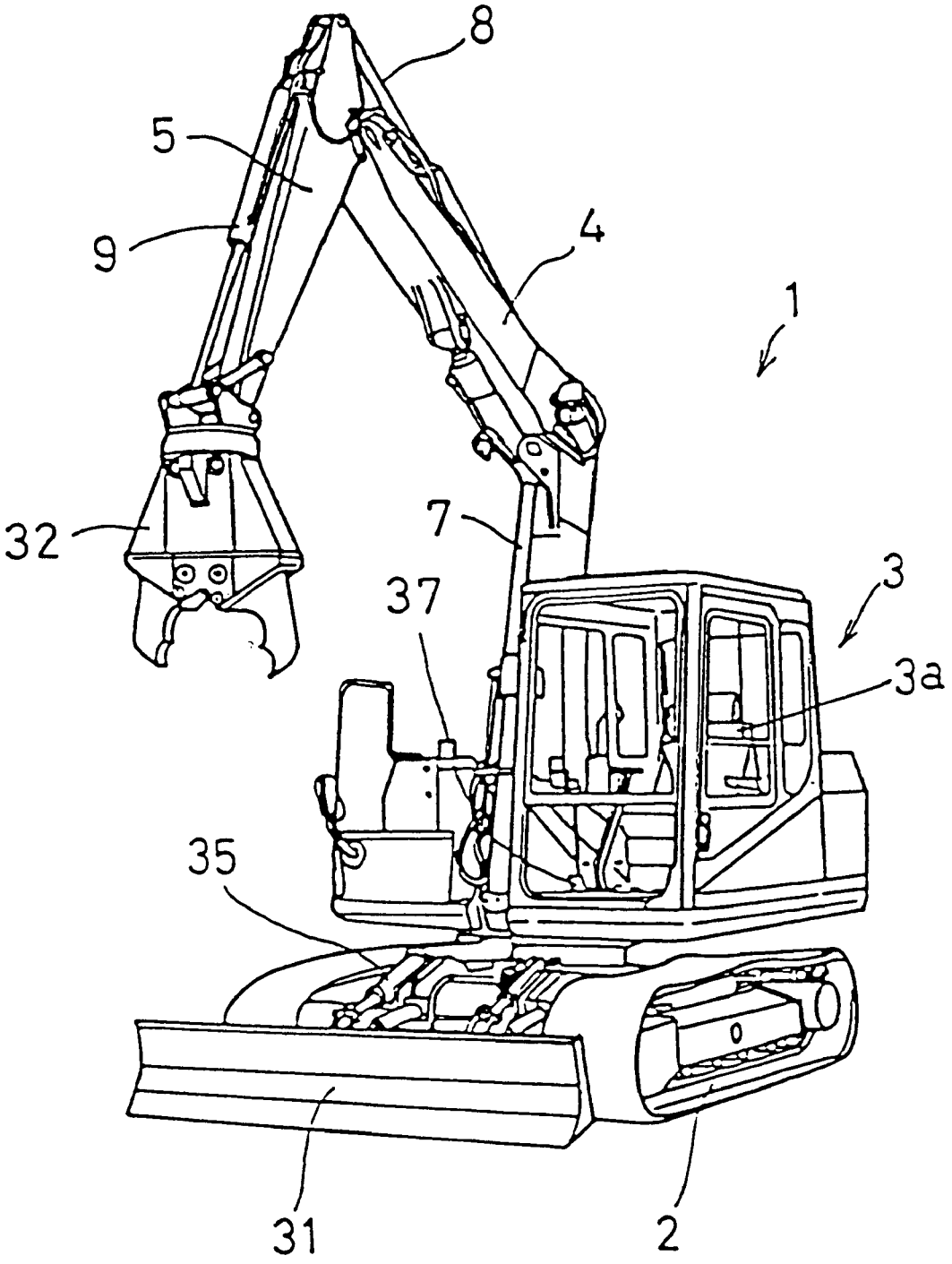
FIG. 3 is a perspective view of a hydraulic shovel according to a second embodiment.
Figure 4:
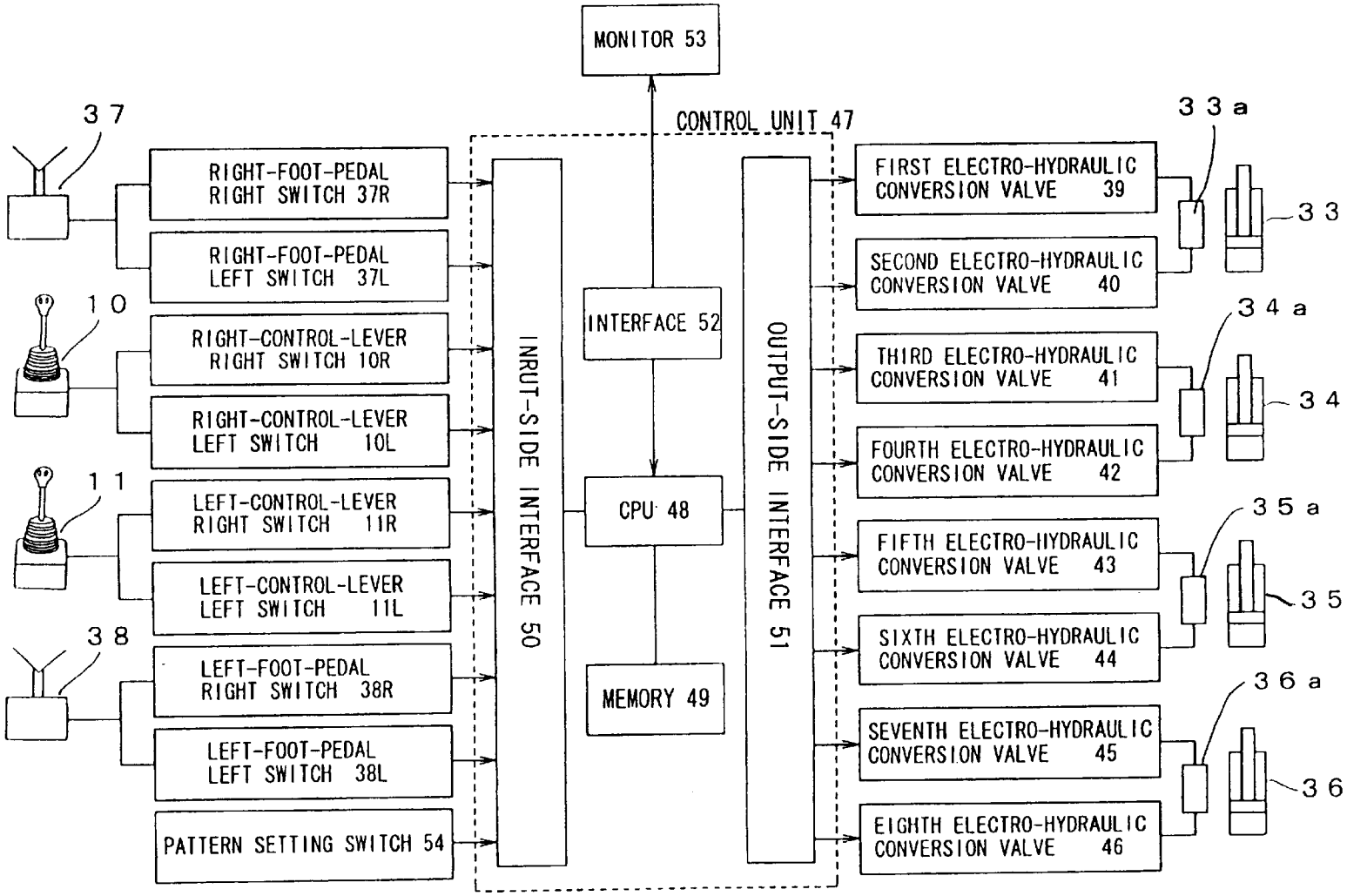
FIG. 4 is a block diagram showing inputs and outputs to and from a control unit.
Figure 5:
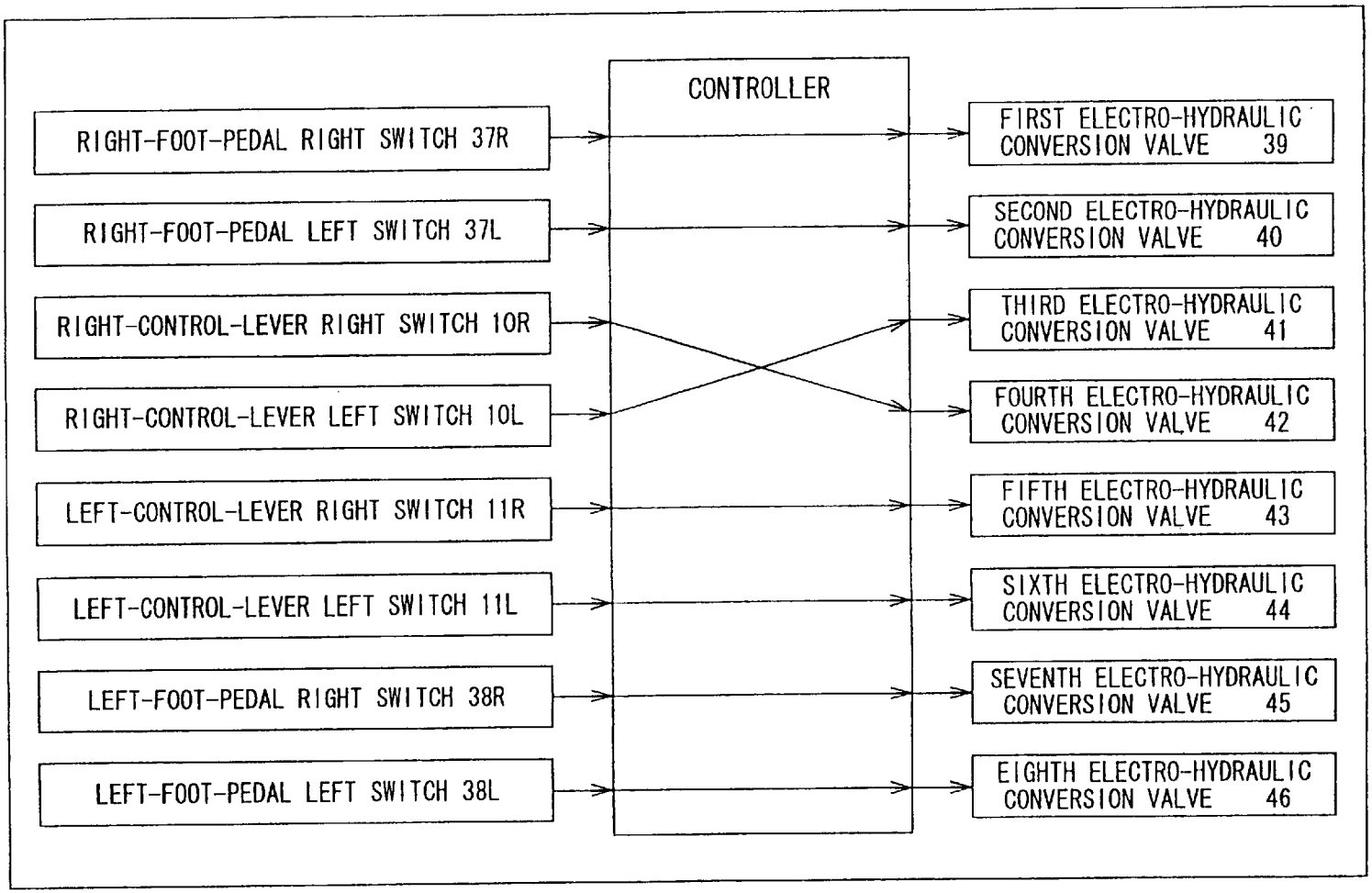
FIG. 5 is a monitor display screen showing one example of correlations between control switches and electro-hydraulic conversion valves.

Next, a second embodiment will be described with reference to FIGS. 3 to 5. A construction machine of this embodiment includes, as external attachments, a dozer 31, which has tilt and angle functions, and a nibbler 32. Correspondingly, the construction machine of this embodiment further includes a dozer up-and-down cylinder 33, a tilt cylinder 34, an angle cylinder 35, and a nibble cylinder 36.

Also, right and left control levers 10, 11 provided on an upper swinging section 3 include control switches 10R, 10L, 11R, 11L arranged on the right and left sides of lever grips, respectively, and right and left foot pedals 37, 38 are provided on a front floor of a cab 3A. The right and left foot pedals 37, 38 are swingable when they are trodden on respectively by the right and left feet, and are associated with sensor switches 37R, 37L, 38R, 38L for detecting tread-on of the foot pedals 37, 38. The nibbler 32 is coupled to a bucket cylinder 9 which serves as a cylinder for oscillating the nibbler 32 in the back-and-forth direction.

Furthermore, the dozer up-and-down cylinder 33 is operated to extend and contract upon switching-over of a first electro-hydraulic conversion valve 39 and a second electro-hydraulic conversion valve 40, thereby operating the dozer 31 vertically. The tilt cylinder 34 is operated to extend and contract upon switching-over of third and forth electro-hydraulic conversion valves 41, 42, thereby performing the tilt operation of the dozer 31. The angle cylinder 35 is set to perform the angle operation upon switching-over of fifth and sixth electro-hydraulic conversion valves 43, 44. The nibble cylinder 36 is set to perform the operations of spreading and clamping the nibbler upon switching-over of seventh and eighth electro-hydraulic conversion valves 45, 46. Incidentally, numeral 33A denotes a control valve for the dozer up-and-down cylinder 33, numeral 34*a* denotes a control valve for the tilt cylinder 34, numeral 35*a* denotes a control valve for the angle cylinder 35, and numeral 36*a* denotes a control valve for the nibble cylinder 36.

The first to eighth electro-hydraulic conversion valves 39–46 are operated to switch over upon receiving control commands from a control unit 47. To this end, as with the above first embodiment, the control unit 47 comprises a CPU 48, a memory (e.g., EEPROM, which stores data in a rewrittable or replaceable manner) 49, an input-side interface 50, an output-side interface 51, etc. Further, the control unit 47 is connected to a monitor 53 via an interface 52, and a pattern setting switch 54 is connected to the input-side interface 50.

Procedures in the case of setting the operational patterns will be described below. As with the above first embodiment, when the pattern setting switch 54 is turned on, the operation of the hydraulic actuator, e.g., "tilt-up", to be set into the operational pattern is displayed on the monitor 53 (the display may be presented in any suitable form such as characters, a symbol, a pattern figure, etc. so long as the operator can recognize "tilt-up"). In this state, the operator turns on one of the control switches, e.g., the right-control-lever right switch 10R, to which he wants to assign "tilt-up". An operating signal from the switch 10R is then inputted to the control unit 47. Upon receiving the switch signal, the control unit 47 sets the correlation between the right-control-lever right switch 10R and the fourth electro-hydraulic conversion valve 42 (i.e., the input/output relationship of outputting the on-signal from the right-control-lever right switch 10R so as to switch over the fourth electro-hydraulic conversion valve 42 for performing the tilt-up operation), and stores the set correlation in the memory 49. Further, the control unit 16 automatically sets the correlation for outputting the operation of a switch in opposed relation to the above "tilt-up" switch 10R, i.e., the switch operation of the right-control-lever left switch 10L, as a signal to switch over the third electro-hydraulic conversion valve 41 for performing the tilt-down operation, and stores the set correlation in the memory 49. Here, in this embodiment, since the right and left switches are disposed in pair for each of the control levers and the foot pedals, the procedures are set such that when the above-described correlation is set by operating one of the right and left switches in each pair, the correlation for the other switch is automatically set so as to output a control command to switch over the corresponding electro-hydraulic conversion valve on the opposite side in response to the switch operation of the other switch, for the purpose of avoiding the troublesome setting works. The operational patterns, however, may be of course set separately for each of the control switches.

Likewise, the other correlations are set by performing the switch operation of the right-foot-pedal right switch 37R to be related with the first electro-hydraulic conversion valve 39 for the dozer-up operation, the switch operation of the left-lever right switch 11R to be related with the fifth electro-hydraulic conversion valve 43 for the forward angle operation, and the switch operation of the left-foot-pedal right switch 38R to be related with the seventh electro-hydraulic conversion valve 45 for the spread operation of the nibbler. Those correlations are also stored in the memory 49.

When the pattern setting switch 54 is turned off after the completion of setting of all the operational patterns, a list of the correlations stored in the memory 49 are displayed on the monitor 53, and the control unit 47 is returned to the "normal control" state. When the switches 10R, 10L, 11R, provided on the control levers 10, 11 and the switches 37R, 37L, 38R, 38L associated with the foot pedals 37, 38 are operated thereafter, corresponding operation commands are outputted to the electro-hydraulic conversion valves 39–46 in accordance with the patterns for the switch operations stored in the memory 49. Note that the patterns for the switch operations stored in the memory 49 are erased by turning on the pattern setting switch 54 next.

While this embodiment is constructed so as to successively display the operations of the hydraulic actuators to be set into the operational patterns, the present invention is not limited to such a construction. For example, the construction may be modified such that the operator can select the hydraulic actuator, for which the setting is to be made, using buttons, a keyboard, or the like provided in the cab.

With the thus-constructed construction machine of this second embodiment, the combinations of the operating pedals 37, 38 and the control switches 10R, 10L, 11R, 11L with the first to eighth electro-hydraulic conversion valves 39–46 can be freely set and rearranged while the operator is sitting in the cab, and therefore similar advantages as with the first embodiment can be provided.

While the first embodiment has been described as changing the correlations with respect to the proportional type electro-hydraulic conversion valves and the second embodiment has been described as setting the correlations with the on/off operations of the switches, it is needless to say that the correlations can be similarly set and changed using other various operating members such as toggle switches Of course, the first embodiment and the second embodiment may be implemented in a combined manner.

In a construction machine, the operator can optionally set correlations between operating members and a plurality of actuators by manipulating the operating members one by one to which the corresponding correlation is to be assigned. As a result, the construction machine enables the operator to set the desired operational patterns at his discretion, and is therefore adaptable for various needs. Since the operational patterns are set upon the operating member being manipulated by the operator himself, the setting is simple to implement and the operator can surely keep in mind the set operational patterns.

In addition, with the construction machine, the set operational patterns are just stored in a memory while the desired operational patterns can be optionally set, as described above. It is therefore possible to reduce the capacity of the memory used, and to avoid an increase in size of the memory.

What is claimed is:

1. A construction machine comprising a plurality of actuators, a plurality of operating members for operating said actuators, and a control unit for receiving operating signals from said operating members and outputting operation commands to said actuators, wherein said control unit is connected to setting means for setting an input/output correlation between any of said plurality of operating members and any of said plurality of actuators, and said control unit includes a memory for storing in a rewritable manner the input/output correlation set by said setting means.

2. The construction machine according to claim 1, wherein said setting means is constructed such that, by manipulating any of said plurality of operating members in a state in which any of said plurality of actuators is selected by selecting means, the input/output relationship between the manipulated operating member and the selected actuator is set.

3. The construction machine according to claim 1, wherein said operating members are comprised of at least one of control levers, control pedals and control switches, and said actuators are operated under at least one of proportional control, on/off control and toggle control.

4. The construction machine according to claim 3, wherein the operating signals are provided from sensors for detecting the directions and angles of the control levers, and said actuators are a boom cylinder, a stick cylinder, a bucket cylinder and a swing hydraulic motor.

5. The construction machine according to claim 3, wherein the operating signals are signals from switches provided on the control levers and the control pedals, and said actuators are a dozer cylinder, a tilt cylinder and an angle cylinder.

6. The construction machine according to claim 2, wherein said operating members are comprised of at least one of control levers, control pedals and control switches, and said actuators are operated under at least one of proportional control, on/off control and toggle control.

7. The construction machine according to claim 4, wherein the operating signals are signals from switches provided on the control levers and the control pedals, and said actuators are a dozer cylinder, a tilt cylinder and an angle cylinder.

8. The construction machine according to claim 1, wherein said plurality of actuators are selectively set.

9. The construction machine according to claim 1, wherein the input/output correlation is set separately for each of the operation commands.

10. A method of setting operation commands, comprising the steps of:

(a) turning on a pattern setting switch;

(b) manipulating an operating member in a desired direction;

(c) assigning an input/output correlation between desired direction and a desired actuator;

(d) setting an input/output correlation between each operating member and each corresponding desired actuator; and (e) storing the input/output correlation.

11. The method of setting operation commands according to claim 10, wherein the operating means may be selected from one of control levers, control pedals and control switches.

12. The method of setting operation commands according to claim 10, having a final step of turning off the pattern setting switch after completion of the setting of all operational patterns.

13. The method of setting operation commands according to claim 10, wherein the input/output correlation is stored in a memory portion.

14. The method of setting operation commands according to claim 10, wherein the desired actuator may be selection from one of a boom cylinder, a stick cylinder, a bucket cylinder, and a swing cylinder.

15. The method of setting operation commands according to claim 10, wherein the input/output correlation is stored in a rewritable manner.

16. A construction machine, comprising:

(a) means for turning on a pattern setting switch;

(b) means for manipulating an operating member in a desired direction;

(c) means for assigning an input/output correlation between desired direction and a desired actuator;

(d) means for setting an input/output correlation between each operating member and each corresponding desired actuator; and (e) means for storing the input/output correlation.

17. The construction machine according to claim 16, wherein the operating member is selected from one of control levers, control pedals and control switches.

18. The construction machine according to claim 16, wherein the input/output correlation is stored in the rewritable storage medium.

19. The construction machine according to claim 16, wherein the desired actuator is selected from one of a boom cylinder, a stick cylinder, a bucket cylinder, and a swing cylinder.

20. The construction machine according to claim 16, further comprising a rewritable storage medium wherein the input/output correlation is stored.

* * * * *